US007233260B2

(12) United States Patent
Tang et al.

(10) Patent No.: US 7,233,260 B2
(45) Date of Patent: Jun. 19, 2007

(54) ELECTRONIC TOLL COLLECTION SYSTEM

(75) Inventors: Wai-Cheung Tang, Mannheim (CA); Thua Van Ho, Mississauga (CA)

(73) Assignee: Mark IV Industries Corp. (CA)

( * ) Notice: Subject to any disclaimer, the term of this patent is extended or adjusted under 35 U.S.C. 154(b) by 226 days.

(21) Appl. No.: 10/959,468

(22) Filed: Oct. 5, 2004

(65) Prior Publication Data

US 2006/0071816 A1 Apr. 6, 2006

(51) Int. Cl.
*G08G 1/00* (2006.01)
*G08B 13/14* (2006.01)
*G07B 15/00* (2006.01)

(52) U.S. Cl. ..... 340/928; 340/572.7; 340/572.4; 340/10.1; 235/384; 705/13

(58) Field of Classification Search ..... 340/928, 340/572.7
See application file for complete search history.

(56) References Cited

U.S. PATENT DOCUMENTS 4,104,630 A 8/1978 Chasek
4,303,904 A 12/1981 Chasek
4,870,419 A 9/1989 Baldwin et al.
4,937,581 A 6/1990 Baldwin et al.
5,086,389 A 2/1992 Hassett et al.
5,132,687 A 7/1992 Baldwin et al.
5,144,553 A 9/1992 Hassett et al.
5,164,732 A * 11/1992 Brockelsby et al. ..... 342/44
5,196,846 A * 3/1993 Brockelsby et al. ..... 340/10.51
5,253,162 A 10/1993 Hassett et al.
5,266,947 A 11/1993 Fujiwara et al.
5,289,183 A 2/1994 Hassett et al.
5,310,999 A 5/1994 Claus et al.
5,351,187 A 9/1994 Hassett
5,424,727 A 6/1995 Shieh
5,425,032 A 6/1995 Shloss et al.
5,485,520 A 1/1996 Chaum et al.
5,525,991 A * 6/1996 Nagura et al. ..... 340/10.51
5,602,375 A 2/1997 Sunahara et al.
5,640,156 A 6/1997 Okuda et al.
5,648,767 A * 7/1997 O'Connor et al. ..... 340/928
5,657,008 A 8/1997 Bantli
5,675,342 A 10/1997 Sharpe
5,701,127 A 12/1997 Sharpe (Continued)

FOREIGN PATENT DOCUMENTS

EP 0 333 679 9/1989

(Continued)

OTHER PUBLICATIONS

U.S. Appl. No. 11/176,758, Unpublished, Wu.

(Continued)

*Primary Examiner*—Donnie L. Crosland
(74) *Attorney, Agent, or Firm*—Hanley, Flight & Zimmerman, LLC

(57) ABSTRACT

An improved electronic toll collection system having two lane-based antennas per laneway. The antennas include an overhead antenna and a side mount antenna. The side mount antenna is disposed so as to communicate especially with license plate transponders. The two antennas are coupled to a transaction processing system for conducting toll transaction communications with a vehicle-mounted transponder through one of the two antennas.

26 Claims, 4 Drawing Sheets

U.S. PATENT DOCUMENTS

| | | | | |
|---|---|---|---|---|
| 5,748,106 | A | 5/1998 | Schoenian et al. | |
| 5,751,973 | A | 5/1998 | Hassett | |
| 5,771,021 | A | 6/1998 | Veghte et al. | |
| 5,777,565 | A | 7/1998 | Hayashi et al. | |
| 5,805,082 | A | 9/1998 | Hassett | |
| 5,819,234 | A | 10/1998 | Slavin et al. | |
| 5,831,547 | A | 11/1998 | Ohtsuki et al. | |
| 5,841,866 | A | 11/1998 | Bruwer et al. | |
| 5,850,191 | A | 12/1998 | Yagi et al. | |
| 5,857,152 | A | 1/1999 | Everett | |
| 5,859,415 | A | 1/1999 | Blomqvist et al. | |
| 5,872,525 | A * | 2/1999 | Fukasawa et al. | 340/928 |
| 5,940,006 | A | 8/1999 | MacLellan et al. | |
| 5,963,149 | A | 10/1999 | Nagura et al. | |
| 6,025,799 | A | 2/2000 | Ho et al. | |
| 6,042,008 | A * | 3/2000 | Ando et al. | 235/384 |
| 6,081,718 | A * | 6/2000 | Ando et al. | 455/447 |
| 6,085,805 | A | 7/2000 | Bates | |
| 6,121,880 | A | 9/2000 | Scott et al. | |
| 6,191,705 | B1 | 2/2001 | Oomen et al. | |
| 6,219,613 | B1 * | 4/2001 | Terrier et al. | 701/207 |
| 6,390,365 | B1 * | 5/2002 | Karasawa | 235/384 |
| 6,616,034 | B2 | 9/2003 | Wu et al. | |
| 6,661,352 | B2 | 12/2003 | Tiernay et al. | |
| 6,690,293 | B2 * | 2/2004 | Amita | 340/928 |
| 6,725,014 | B1 | 4/2004 | Voegele | |
| 6,898,753 | B2 | 5/2005 | Bonifas | |
| 2001/0050922 | A1 | 12/2001 | Tiernay et al. | |
| 2006/0082470 | A1 | 4/2006 | Zhu et al. | |

FOREIGN PATENT DOCUMENTS

| | | |
|---|---|---|
| JP | 10-105753 | 4/1998 |
| WO | WO/9933027 | 1/1999 |

OTHER PUBLICATIONS

Ching et al., *A Laser Micromachined Multi-Modal Resonating Power Transducer for Wireless Sensing Systems*, Sensors and Actuators A 97-98 (2002) 685-690, http://www.elsevier.com.

Finkenzeller, Klaus, *Ch. 3: Fudamental Operating Principles, RFID Handbook: Fundamentals and Applications in Contactless Smart Cards and Identification*, Klaus Finkenzellar, (2003) John Wiley & Sons, Ltd. ISBN 0-470-84402-7.

Sorrells, *Passive RFID Basics*, AN680, Michrochip Technology Inc., (1998) DS00680B.

Woo et al., Dual Mode Electronic Toll Collection Transponder, U.S. Appl. No. 11/409,897, filed Apr. 24, 2006.

Woo et al., Open Road Vehicle Emissions Inspection, U.S. Appl. No. 11/409,741, filed Apr. 24, 2006.

Jeffrey Zhu, System and Method for Secure Mobile Commerce, U.S. Appl. No. 10/912,997, filed Aug. 16, 2004.

Tang, RF Transponder with Electromechanical Power, U.S. Appl. No. 11/054,520, filed Feb. 9, 2005.

Ho et al., Compact Transponder Antenna, U.S. Appl. No. 11/388,737, filed Mar. 24, 2006.

Zhu, Phase Modulation for Backscatter Transponders, U.S. Appl. No. 11/098,257, filed Apr. 4, 2005.

Ho et al., Dynamic Timing Adjustment in an Electronic Toll Collection System, U.S. Appl. No. 11/176,758, filed Jul. 7, 2005.

Tang et al., Method of Enabling Two-State Operation of Electronic Toll Collection System, U.S. Appl. No. 11/437,236, filed May 19, 2006.

Tang et al., Method and System for Obtaining Traffic Information Using Transponders, U.S. Appl. No. 11/284,277, filed Nov. 21, 2005.

* cited by examiner

ELECTRONIC TOLL COLLECTION SYSTEM

FIELD OF THE INVENTION

The present invention relates to radio frequency (RF) electronic toll collection.

BACKGROUND OF THE INVENTION

Electronic toll collection systems conduct toll transactions electronically using RF communications between a vehicle-mounted transponder (a "tag") and a stationary toll plaza transceiver (a "reader"). An example of an electronic toll collection system is described in U.S. Pat. No. 6,661,352 issued Dec. 9, 2003 to Tiernay et al., and owned in common with the present application, the contents of which are hereby incorporated by reference. Typical electronic toll collection systems provide for toll plazas having reader antennas located above the toll road mounted on an overhead gantry or other support structure. The overhead antennas are directional and are intended to communicate with transponders or tags passing beneath them on the toll road.

A vehicular transponder or tag is typically one of two types: a windshield transponder or a license plate transponder. The windshield transponder is mounted to the interior or exterior of the windshield and is particularly well adapted to communicate with an overhead antenna. Due to its location, the windshield transponder usually enjoys a clear RF transmission path to an overhead gantry.

For various reasons, a vehicle may be equipped with a license plate transponder instead of a windshield transponder. The license plate transponder is less well adapted for communications with an overhead gantry than the windshield transponder. The license plate transponder suffers from the dB loss associated with being mounted lower on the vehicle, i.e. further from the overhead antenna. In addition, the license plate transponder may encounter multipath problems due to reflections off of the road surface. These multipath problems can result in signal cancellation at certain mounting heights Accordingly, it would be advantageous to provide for an improved electronic toll collection system or method of operating such a system.

SUMMARY OF THE INVENTION

The present invention provides an improved electronic toll collection system. The system provides two lane-based antennas per laneway. The antennas include an overhead antenna and a side mount antenna. The side mount antenna is disposed so as to communicate with license plate transponders. The two antennas are coupled to a transaction processing system for conducting toll transaction communications with a vehicle-mounted transponder through one of the two antennas.

In one aspect, the present invention provides a system for electronic toll collection in connection with a vehicle having a transponder, the vehicle travelling in a laneway. The system includes a first antenna for transmitting a first signal to the transponder and for receiving a response signal from the transponder and being disposed above the laneway, and a second antenna for transmitting a second signal to the transponder and for receiving the response signal from the transponder and being disposed at a side of the laneway. The system also includes a transaction processor coupled to the first antenna and to the second antenna for controlling generation of the first signal and the second signal and for processing the response signal received from the first antenna or from the second antenna.

In another aspect, the present invention provides a reader for use in a toll plaza for obtaining toll payment from a vehicle travelling in a laneway, the vehicle having a transponder. The reader includes a first lane-based antenna positioned overhead of the laneway and having a beam path directed substantially downwards towards the laneway, and a second lane-based antenna positioned at a side of the laneway and having a beam path directed substantially transverse to the laneway. The reader also includes a transaction processing system coupled to the first lane-based antenna and coupled to the second lane-based antenna and including a transceiver for exciting the antennas to induce propagation of an output signal and for receiving response signals from the transponder through at least one of the antennas, and wherein the transaction processing system performs toll transaction processing.

In another aspect, the present invention provides a method for communicating with a vehicle-mounted transponder in an electronic toll collection system using a predefined communications protocol, the electronic toll collection system including a transaction processing system and, for a laneway in a toll plaza, an overhead antenna and a side mount antenna, the side mount antenna being disposed at a side of the laneway, the overhead antenna and the side mount antenna being coupled to the transaction processing system. The method includes steps of propagating a first signal using the overhead antenna, and, if the overhead antenna receives a response signal from the transponder, then conducting a transaction process in accordance with the predefined communications protocol using the overhead antenna. It also includes steps of propagating a second signal using the side mount antenna, and, if the side mount antenna receives a response signal from the transponder, then conducting the transaction process in accordance with the predefined communications protocol using the side mount antenna.

Other aspects and features of the present invention will be apparent to those of ordinary skill in the art from a review of the following detailed description when considered in conjunction with the drawings.

BRIEF DESCRIPTION OF THE DRAWINGS

Reference will now be made, by way of example, to the accompanying drawings which show an embodiment of the present invention, and in which.

Similar reference numerals are used in different figures to denote similar components.

DESCRIPTION OF SPECIFIC EMBODIMENTS

Figure 1:
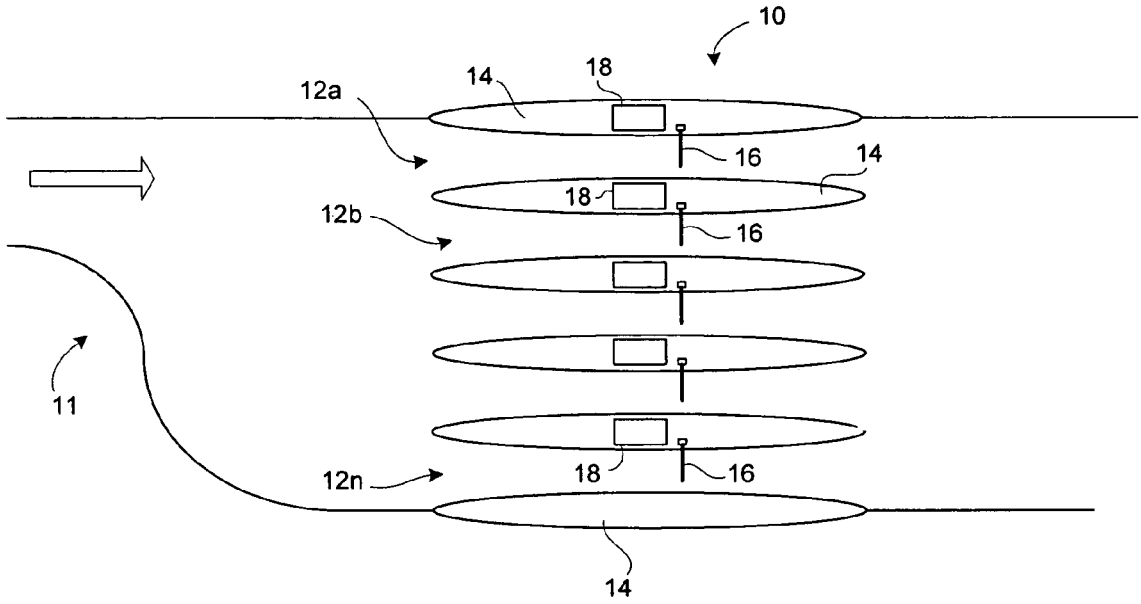
FIG. 1 diagrammatically shows a multi-lane roadway containing a toll plaza.

Reference is first made to FIG. 1, which shows a multi-lane roadway 11 containing a toll plaza 10. As indicated in FIG. 1, traffic flow for the multi-lane roadway 11 is from left to right in the diagram. Vehicles entering the widened portion of the multi-lane roadway 11 proceed to the toll plaza 10, wherein the vehicle is required to pay a toll before exiting the toll plaza 10.

It will be understood that, as described in U.S. Pat. No. 6,661,352, the toll plaza 10 may incorporate a wide area communications zone prior to the lane-based communications zone described below.

The toll plaza 10 includes a set of individual lanes 12*a*, 12*b*, . . . 12*n* separated by islands 14. Each individual lane 12 may have an associated barrier 16, such as a pivotable arm barrier to prevent drivers from proceeding through the toll plaza 10 prior to payment of the toll. It will be understood that the toll plaza 10 may have an additional or alternative indicator, such as a traffic light, to inform drivers as to whether or not they are entitled to proceed through the toll plaza 10. Each individual lane 12 may also have an associated toll booth 18 located on an adjacent island 14, which may be manned by personnel to conduct cash transactions with drivers for payment of the requisite toll.

Figure 2:
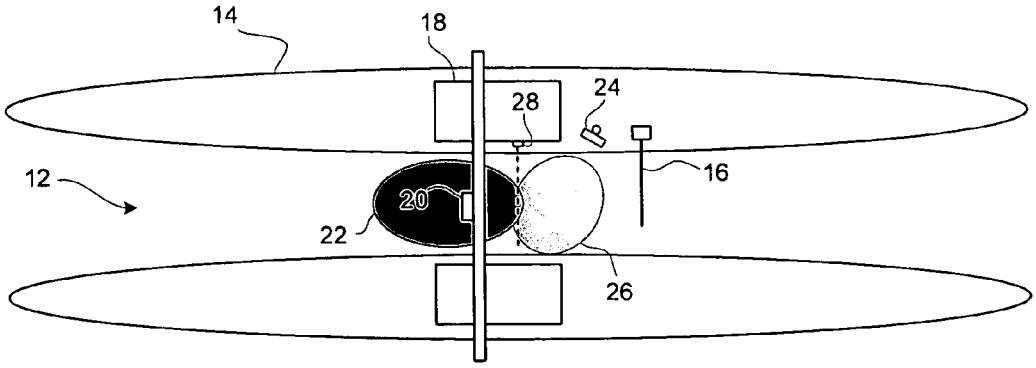
FIG. 2 diagrammatically shows a top view of one of the lanes of the toll plaza shown in FIG. 1.
Figure 3:
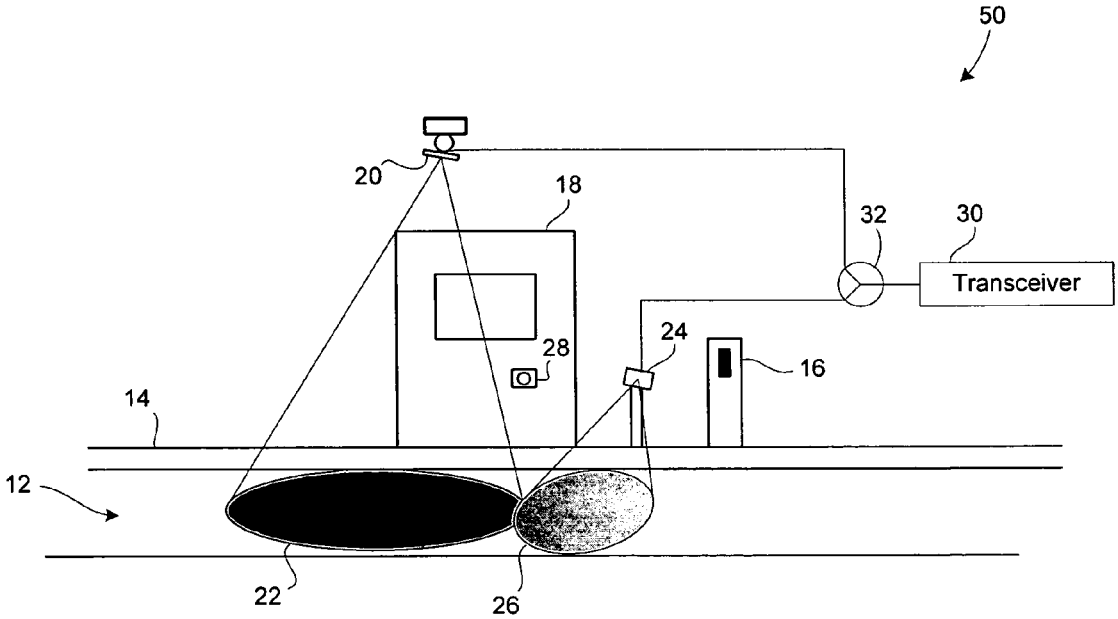
FIG. 3 diagrammatically shows a side view of one of the lanes of the toll plaza shown in FIG. 1.
Figure 5:
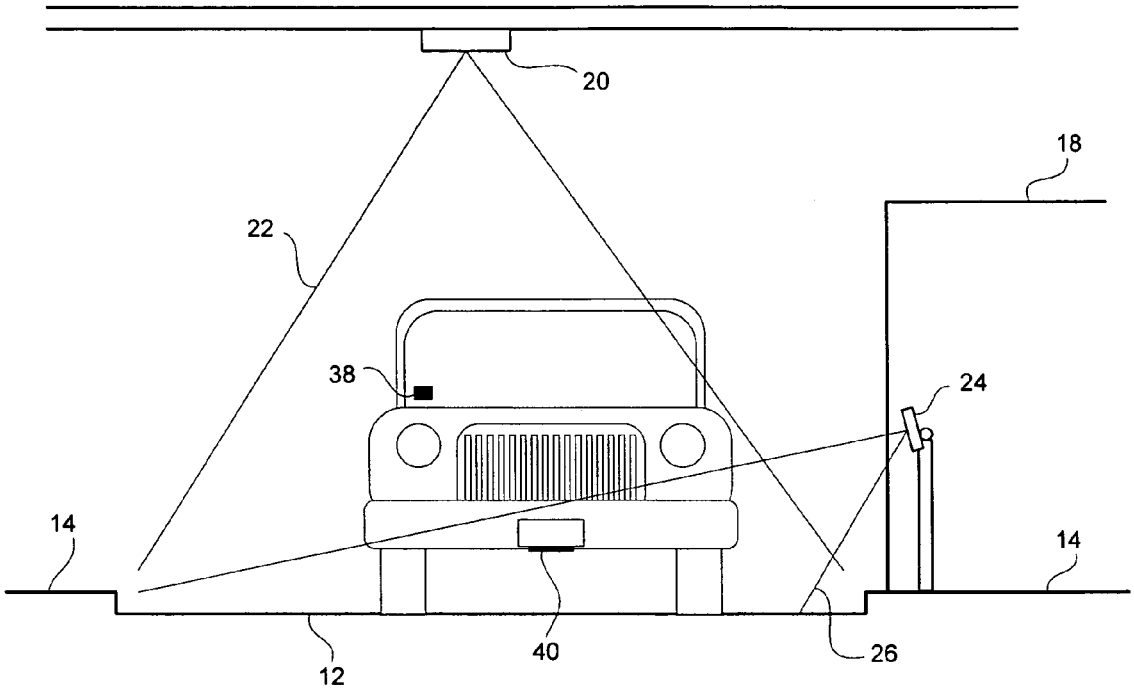
FIG. 5 diagrammatically shows a front view of one of the lanes of the toll plaza shown in FIG. 1.

In conjunction with FIG. 1, reference is made to FIGS. 2, 3 and 5 which diagrammatically show a top view, a side view and a front view, respectively, of one of the lanes 12 of the toll plaza 10 shown in FIG. 1.

The toll plaza 10 implements an electronic toll collection system 50 in which individual vehicles are equipped with a transponder that communicates with a reader at the toll plaza 10 in order to conduct a toll transaction. The electronic toll collection system 50 includes an overhead antenna 20 associated with each individual lane 12. Each overhead antenna 20 may be mounted to an overhead gantry or other support structure and is directed substantially downwards into its associated laneway. Each overhead antenna 20 is directional and has a beam path defining a capture zone 22 in the individual lane 12. The capture zone 22 of the overhead antenna 20 is substantially confined to its associated individual lane 12 so as not to receive communications from transponders in adjacent laneways.

The overhead antenna 20 is coupled to a transceiver 30, which excites the antenna 20 with electrical signals so as to induce propagation of an RF signal in the associated capture zone 22. The antenna 20 receives incoming RF signals, which are input to the transceiver 30. The incoming RF signals include transmissions from any active transponders within the capture zone 22. It will be appreciated that the electronic toll collection system 50 may be based upon one or more pre-defined communications protocols and may involve the use of active or backscatter transponders.

A vehicular transponder is typically one of two types: a windshield mounted transponder (WMT) 38 (FIG. 5) or a license plate transponder (LPT) 40 (FIG. 5). The WMT 38 is mounted to the interior or exterior of the windshield and is particularly well adapted to communicate with the overhead antenna 20. Due to its location, the WMT usually enjoys a clear RF transmission path to an overhead gantry.

For various reasons, a particular vehicle may use an LPT 40 instead of a WMT 38. For example, circumstances in which an LPT 40 may be used include where a windshield is metalized, which may interfere with proper operation of a WMT 38. In addition, certain vehicles have overhanging materials that obscure the path between an overhead gantry and the vehicle windshield, such as a car carrier truck. In these and other cases a vehicle may be equipped with an LPT 40.

The LPT 40 is less well adapted for communications with an overhead gantry than the WMT 38. The LPT 40 suffers from the dB loss associated with being mounted lower on the vehicle, i.e. further from the overhead antenna 20. In addition, the LPT 40 may encounter multipath problems due to reflections off of the laneway surface. These multipath problems can result in signal cancellation at certain mounting heights.

In accordance with the present invention, the electronic toll collection system 50 further includes a side mount antenna 24. The side mount antenna 24 is a lane-based antenna located at one side of the individual lane 12. The side mount antenna 24 may be mounted to a post or other support structure and is directed substantially transverse to its associated lane 12 and somewhat downwards into its associated lane 12. The side mount antenna 24 is directional and has a beam path defining a capture zone 26 in the individual lane 12. The capture zone 26 of the side mount antenna 24 is substantially confined to its associated individual lane 12 so as not to receive communications from transponders in adjacent laneways.

The side mount antenna 24 is positioned and directed so as to define the capture zone 26 such that it includes the license plate mounting areas of most vehicles but excludes the windshield area of most vehicles, as shown best in FIG. 5. Accordingly, in one embodiment, the capture zone 26 of the side mount antenna 24 spans substantially the width of the laneway and includes a volume approximately two to four feet high at the center point of the lane 12. The side mount antenna 24 may be mounted approximately three to five feet above the individual lane 12, with its beam path directed substantially across the lane 12 and inclined downwards at a shallow angle. The side mount antenna 24 may also be directed somewhat towards oncoming vehicles, i.e. against the flow of traffic, so as to be directed towards front mounted LPTs 40, as shown best in FIGS. 2 and 3.

The side mount antenna 24 is coupled to the transceiver 30. In one embodiment, the transceiver 30 comprises two separate transceivers: one for the overhead antenna 20 and one for the side mount antenna 24; however, in another embodiment, the transceiver 30 comprises a single transceiver coupled to both the antennas 20, 24. In one embodiment, the transceiver 30 includes a signal output port, which is coupled to the antennas 20, 24 through a splitter 32. In this embodiment, the antennas 32 each receive the same signal. In another embodiment, the antennas 20, 24 are coupled to the signal output port through a switch, wherein the switch operates in response to control signals from the transceiver to control which antenna 20, 24 is actively coupled to the transceiver 30. In yet another embodiment, the transceiver includes a separate output port for each antenna 20, 24. It will be understood that some additional amplification or attenuation may be used at various points in the circuit between the transceiver 30 and the antennas 20, 24 to modify a pre-existing single antenna system to create an embodiment according to the present invention.

In the embodiments of the present invention described below, the side mount antenna 24 and its capture zone 26 are located downstream from the overhead antenna 20 and its capture zone 22; however, it will be understood that in other embodiments, the side mount antenna 24 and its capture zone 26 may be located upstream from the overhead antenna 20 and its capture zone 22.

In systems having only the overhead antenna 20, the transceiver 30 ensures that once a transponder is identified and a transaction is processed that any subsequent communications from the same transponder are ignored, so that multiple transactions do not occur. In the present embodiment, the transceiver 30 initially receives transponder communications in the capture zone 22 for the overhead antenna 20. If a transponder transaction occurs in this zone, then any subsequent attempts by the transponder to re-communicate are ignored. This includes attempts to communicate once the transponder is located in the capture zone 26 for the side mount antenna 24. Accordingly, the two captures zones 22, 26 will not result in duplicate sequential transactions.

In addition to preventing duplicate sequential transactions the electronic toll collection system 50 may address the issue of simultaneous communications. This issue could arise where a transponder in the individual lane 12 sends a communication that is picked up by both the overhead antenna 20 and the side mount antenna 24. In one embodiment, this is resolved by ensuring that the respective capture zones 22, 26 do not overlap. Without overlap, the transponder cannot be located in both zones 22, 26 at the same time, so it cannot communicate with both antennas 20, 24 at the same time. Prevention of capture zone overlap may be achieved through controlling the mounting position of the antennas 20, 24, controlling the directionality of the antennas 20, 24 or controlling the power of the antenna transmissions.

In another embodiment, the capture zones 22, 26 have some amount of overlap and the electronic toll collection system 50 prevents any collisions. In one embodiment, the system 50 prevents collisions in the overlap area through frequency multiplexing the communications signals. The electronic toll collection system 50 may provide more than one channel/frequency for communications between readers and transponders; in some embodiments four or more channels. Adjacent lanes may employ different channels to avoid cross-talk. Accordingly, in one embodiment, the overhead antenna 20 and the side-mount antenna 24 are tuned to different frequencies and/or may be driven by driving signals having different frequencies.

In yet another embodiment, the system 50 avoids collisions in the overlapped zones through time-division multiplexing. In this embodiment, only one antenna 20, 24 operates at a time.

Those of ordinary skill in the art will appreciate that there may be other variations for avoiding collisions or simultaneous communications.

In another embodiment, the electronic toll collection system 50 includes a vehicle sensor 28. The vehicle sensor 28 is a sensor designed and located to sense the presence of a vehicle in the individual lane 12. The vehicle sensor 28 may be disposed to sense when a vehicle enters the beginning of the capture zone 26 for the side mount antenna 24. Accordingly, if no transaction has been conducted for a vehicle and the vehicle sensor 28 indicates that the vehicle has passed through the capture zone 22 for the overhead antenna 22, then in response to signals from the vehicle sensor 28 the system 50 may discontinue using the overhead antenna 20 and may begin using the side mount antenna 24. Therefore, the vehicle sensor 28 may be incorporated into a time-division multiplexing scheme for establishing communications with a transponder. If a vehicle transponder is successfully read by the overhead antenna 22 then the vehicle sensor 28 signal may be ignored by the system 50 and the side mount antenna 24 may not be activated.

In one embodiment, the vehicle sensor 28 comprises an infrared sensor. The infrared sensor projects a beam across the laneway 12 and senses if the beam is interrupted by the presence of a vehicle. The infrared sensor may be mounted to the toll booth 18, to a post, or any other suitable structure for fixing it in position.

The vehicle sensor 28 may comprise any other sensor for establishing the position of a vehicle, including magnetic sensors, pressure plates, and digital cameras. Those of ordinary skill in the art will appreciate the range of devices that may be used for this purpose.

It will be understood that the system 50 may employ more than one vehicle sensor 28 to sense the position of a vehicle. Additional vehicle sensors may be located, for example, prior to the capture zone 22 for the overhead antenna 22 to trigger operation of the overhead antenna 22.

Figure 4:
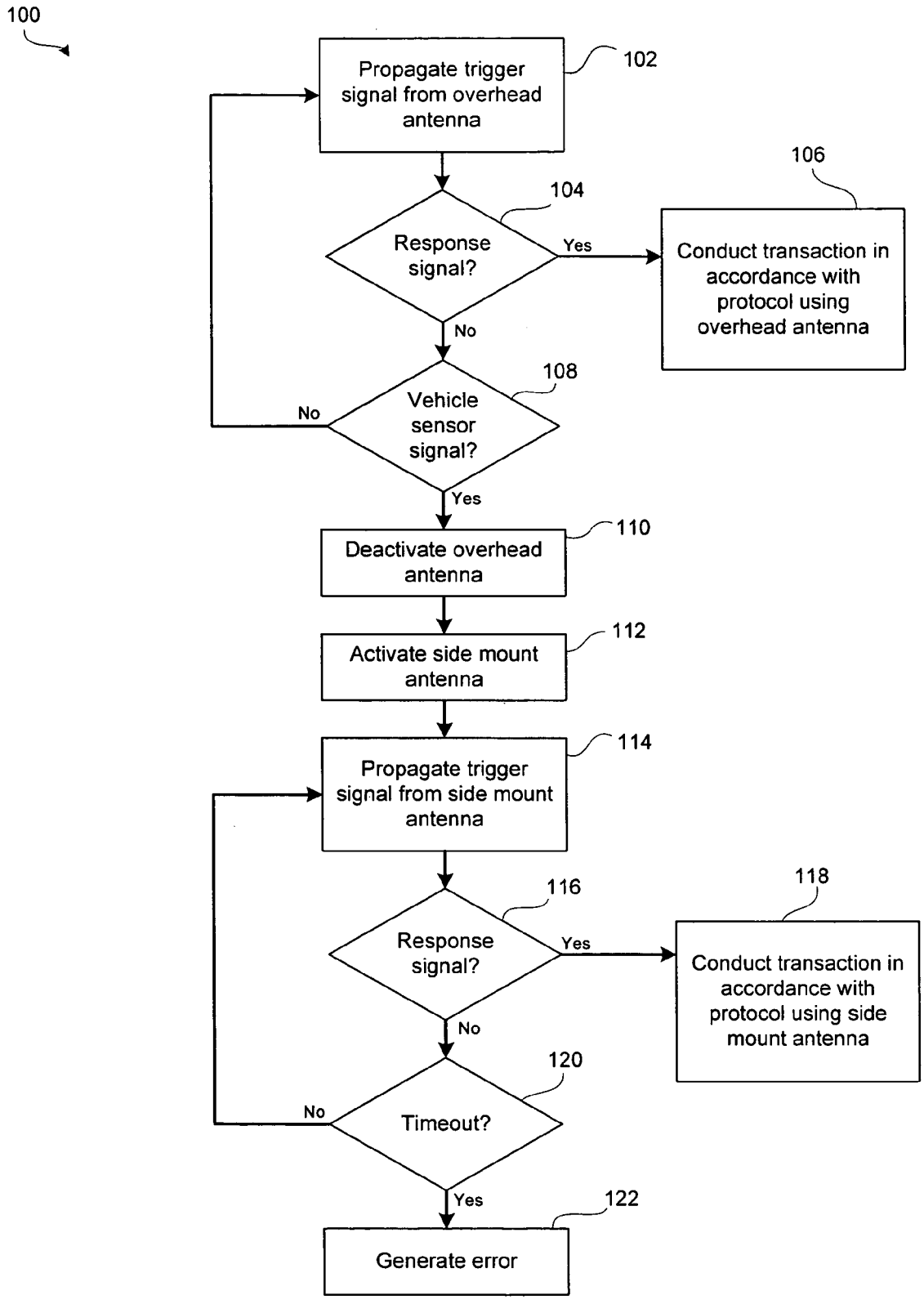
FIG. 4 shows, in flowchart form, a method of establishing communications with a vehicle transponder.

Together with FIG. 3, reference is now made to FIG. 4, which shows, in flowchart form, a method 100 of establishing communications with a vehicle transponder. The method 100 is based upon a system employing active transponders operating in accordance with a predefined communications protocol whereby the transponder broadcasts a response signal containing transponder information in response to a trigger signal sent by the transceiver. It will be understood that the present invention is applicable to other systems employing other protocols, including backscatter systems and systems wherein a polling message is broadcast by a reader. The method 100 is further based upon an embodiment of the electronic toll collection system 50 using the vehicle sensor 28 to deactivate the overhead antenna 20 and activate the side mount antenna 24. Those of ordinary skill in the art will appreciate that various modifications or variations to the method 100 may be made to adapt it to other embodiments of the electronic toll collection system 50.

The method 100 begins in step 102, wherein the overhead antenna 20 broadcasts a trigger signal within the capture zone 22. In step 104, the system 50 evaluates whether or not it has received a response signal from a transponder within the capture zone 22. If a response signal has been received, then the method 100 proceeds to step 106 wherein the system 50 conducts a toll transaction with the transponder in accordance with the predefined communications protocol. The toll transaction is conducted using the overhead antenna and may comprise the calculation of a debit amount, the sending of a programming signal to the transponder, and the receipt of a verification signal containing transponder information updated in accordance with the programming signal.

If no response signal is received, then the method 100 continues at step 108, where the system determines whether or not the vehicle sensor 28 has sensed a vehicle. If the vehicle sensor 28 has not indicated that a vehicle is present, then the method 100 returns to step 102 to continue to try to establish communications with any transponders that may be located in the capture zone 22 of the overhead antenna 20. If the vehicle sensor 28 has sensed a vehicle, then it indicates that a vehicle has passed through at least a part of the capture zone 22 for the overhead antenna 20 without successfully establishing communications. Accordingly, if a vehicle is discovered by the vehicle sensor 28, then the method 100 proceeds to steps 110 and 112 wherein the overhead antenna 20 is deactivated and the side mount antenna is activated 24.

In step 114 the system 50 broadcasts a trigger signal in the capture zone 26 using the side mount antenna 24. If a response signal is detected in step 116, then in step 118 the toll transaction is conducted in accordance with the predefined communications protocol using the side mount antenna 24. If no response signal is detected, then in step 120 the system 50 determines whether it has timed out. A time out procedure may be employed since, if communications cannot be successfully established after a preset period of time, then the system 50 may presume that the vehicle is not equipped with a transponder or has a malfunctioning transponder. If a timeout occurs, then the system 50 may generate an error message in step 122. The error message may comprise a signal or alarm to signal to a toll booth operator that no toll transaction has been conducted for the vehicle present in the individual lane 12.

If the system 50 has not timed out, then after step 120 the method 100 returns to step 114 to continue to attempt to establish communications with a transponder in the capture zone 26.

The present invention may be embodied in other specific forms without departing from the spirit or essential characteristics thereof. Certain adaptations and modifications of the invention will be obvious to those skilled in the art. Therefore, the above discussed embodiments are considered to be illustrative and not restrictive, the scope of the invention being indicated by the appended claims rather than the foregoing description, and all changes which come within the meaning and range of equivalency of the claims are therefore intended to be embraced therein.

What is claimed is:

1. A system for electronic toll collection in connection with a vehicle having a transponder, the vehicle travelling in a laneway, the system comprising:

a vehicle sensor for detecting the vehicle in the laneway;

a first antenna for transmitting a first signal to the transponder and for receiving a response signal from the transponder and being disposed above the laneway;

a second antenna for transmitting a second signal to the transponder and for receiving the response signal from the transponder and being disposed at a side of the laneway; and a transaction processor coupled to said first antenna and to said second antenna for controlling generation of said first signal and said second signal and for processing said response signal received from said first antenna or from said second antenna, wherein said transaction processor is configured to generate said second signal in response to detection of the vehicle by the vehicle sensor only if no response signal is received by said first antenna in response to said first signal.

2. The system claimed in claim 1, wherein said first antenna defines a first capture zone and wherein said second antenna defines a second capture zone.

3. The system claimed in claim 2, wherein the laneway includes a direction of travel, and wherein said first capture zone is upstream of said second capture zone with regard to said direction of travel.

4. The system claimed in claim 2, wherein a portion of said first capture zone overlaps a portion of said second capture zone.

5. The system claimed in claim 2, wherein the vehicle includes a windshield area and a licence plate mounting area, and wherein said second capture zone includes said licence plate mounting area and excludes said windshield area when the vehicle is in the laneway.

6. The system claimed in claim 2, wherein said second antenna is mounted between three and five feet above a surface of the laneway.

7. The system claimed in claim 2, wherein said second capture zone defines a volume substantially spanning the laneway and having a height of between two and four feet at a centre point in the laneway.

8. The system claimed in claim 1, wherein said transaction processor includes a transceiver, and wherein said transceiver controls said first antenna and said second antenna so as to transmit said first signal and said second signal at mutually exclusive times.

9. The system claimed in claim 8, wherein said vehicle sensor is disposed between said first antenna and said second antenna, and wherein said transceiver deactivates said first antenna and activates said second antenna in response to detection of the vehicle by said vehicle sensor.

10. A reader for use in a toll plaza for obtaining toll payment from a vehicle travelling in a laneway, the vehicle having a transponder, the reader comprising:

a vehicle sensor for detecting the vehicle in the laneway;

a first lane-based antenna positioned overhead of the laneway and having a beam path directed substantially downwards towards the laneway;

a second lane-based antenna positioned at a side of the laneway and having a beam path directed substantially transverse to the laneway; and a transaction processing system coupled to said first lane-based antenna and coupled to said second lane-based antenna and including a transceiver for exciting said antennas to induce propagation of an output signal and for receiving a response signal from the transponder through at least one of said antennas, and wherein said transaction processing system performs toll transaction processing, wherein said transaction processor is configured to excite said second antenna in response to detection of the vehicle by the vehicle sensor only if no response signal is received by said first antenna in response to excitation of said first antenna.

11. The reader claimed in claim 10, wherein said beam path of said first lane-based antenna defines a first capture zone and wherein said beam path of said second lane-based antenna defines a second capture zone.

12. The reader claimed in claim 11, wherein the laneway includes a direction of travel, and wherein said first capture zone is upstream of said second capture zone with regard to said direction of travel.

13. The reader claimed in claim 11, wherein a portion of said first capture zone overlaps a portion of said second capture zone.

14. The reader claimed in claim 11, wherein the vehicle includes a windshield area and a licence plate mounting area, and wherein said second capture zone includes said licence plate mounting area and excludes said windshield area when the vehicle is in the laneway.

15. The reader claimed in claim 11, wherein said second lane-based antenna is mounted between three and five feet above a surface of the laneway.

16. The reader claimed in claim 11, wherein said second capture zone defines a volume substantially spanning the laneway and having a height of between two and four feet at a centre point in the laneway.

17. The reader claimed in claim 10, wherein said transceiver induces propagation of a first signal from said first lane-based antenna and induces propagation of a second signal from said second lane-based antenna, and wherein said first signal and said second signal are transmitted at different times.

18. The reader claimed in claim 17, wherein said vehicle sensor is disposed between said first lane-based antenna and said second lane-based antenna, and wherein said transceiver is configured to deactivate said first lane-based antenna and activate said second lane-based antenna in response to said vehicle sensor.

19. A method for communicating with a vehicle-mounted transponder in an electronic toll collection system using a predefined communications protocol, said electronic toll collection system including a transaction processing system and, for a laneway in a toll plaza, an overhead antenna and a side mount antenna, the side mount antenna being disposed at a side of the laneway, the overhead antenna and the side mount antenna being coupled to the transaction processing system, the system including a vehicle sensor for detecting the vehicle in the laneway, the method comprising the steps of:

propagating a first signal using the overhead antenna;

if the overhead antenna receives a response signal from the transponder, then conducting a transaction process in accordance with the predefined communications protocol using the overhead antenna;

determining that the vehicle is present in the laneway and, if the overhead antenna does not receive said response signal form the transponder, propagating a second signal using the side mount antenna; and if the side mount antenna receives a response signal from the transponder, then conducting the transaction process in accordance with the predefined communications protocol using the side mount antenna.

20. The method claimed in claim 19, wherein said overhead antenna defines a first capture zone and wherein said side mount antenna defines a second capture zone, and wherein said first signal is propagated in said first capture zone and wherein said second signal is propagated in said second capture zone.

21. The method claimed in claim 20, wherein the laneway includes a direction of travel, and wherein said first capture zone is upstream of said second capture zone with regard to said direction of travel.

22. The method claimed in claim 20, wherein a portion of said first capture zone overlaps a portion of said second capture zone.

23. The method claimed in claim 20, wherein the vehicle includes a windshield area and a licence plate mounting area, and wherein said second capture zone includes said licence plate mounting area and excludes said windshield area when the vehicle is in the laneway.

24. The method claimed in claim 20, wherein said step of determining includes determining if the vehicle has passed through a substantial portion of said first capture zone and wherein said steps of propagating the second signal and conducting the transaction process using the side mount antenna are performed in response to said vehicle sensor.

25. The method claimed in claim 24, further including a step of generating an error signal if neither the overhead antenna nor the side mount antenna have received the response signal after a predetermined time period.

26. The method claimed in claim 19, wherein said steps of propagating a first signal and propagating a second signal are performed at different times.

* * * * *